US011912527B1

(12) United States Patent
Bigbee, Jr. et al.

(10) Patent No.: US 11,912,527 B1
(45) **Date of Patent: *Feb. 27, 2024**

(54) APPARATUS AND METHOD FOR A FREE-SPINNING WIRE DISPENSING REEL

(71) Applicant: Encore Wire Corporation, McKinney, TX (US)

(72) Inventors: William T. Bigbee, Jr., Melissa, TX (US); John L. Rhoads, Lewisville, TX (US)

(73) Assignee: Encore Wire Corporation, McKinney, TX (US)

( * ) Notice: Subject to any disclaimer, the term of this patent is extended or adjusted under 35 U.S.C. 154(b) by 11 days.

This patent is subject to a terminal disclaimer.

(21) Appl. No.: 17/407,988

(22) Filed: Aug. 20, 2021

Related U.S. Application Data

(63) Continuation of application No. 16/823,112, filed on Mar. 18, 2020, now Pat. No. 11,111,100, which is a continuation of application No. 15/990,687, filed on May 28, 2018, now Pat. No. 10,618,768, which is a continuation of application No. 15/251,695, filed on Aug. 30, 2016, now Pat. No. 10,000,356, which is a (Continued)

(51) Int. Cl.
*B65H 49/32* (2006.01)
*B65H 75/44* (2006.01)

(Continued)

(52) U.S. Cl.
CPC ..... *B65H 49/32* (2013.01); *B65H 49/324* (2013.01); *B65H 75/146* (2013.01); *B65H 75/18* (2013.01); *B65H 75/4428* (2013.01)

(58) Field of Classification Search
CPC .... B65H 49/32; B65H 49/324; B65H 75/146; B65H 75/18; B65H 75/40; B65H 75/4428
See application file for complete search history.

(56) References Cited

U.S. PATENT DOCUMENTS 709,932 A 9/1902 Schooley
970,884 A 9/1910 Carter
(Continued)

FOREIGN PATENT DOCUMENTS

GB 353684 A 7/1931

OTHER PUBLICATIONS

Carrisreels, "10-inch Caddies for in-the-box packaging reels from Carris Reels", Carris Reels, Inc. 2008, http://carris.com/products/caddy10.html (Printed from website Oct. 11, 2012).

*Primary Examiner* — William E Dondero
(74) *Attorney, Agent, or Firm* — Warren Rhoades LLP

(57) ABSTRACT

An apparatus and method for dispensing wire or cable from a reel assembly. In one embodiment, the apparatus comprises an inner flange assembly and an outer flange assembly. The inner flange assembly is capable of freely rotating relative to the outer flange assembly for dispensing wire from any surface. In another embodiment, the apparatus includes an inner flange assembly, an outer flange assembly, and an external bay. The inner flange assembly is capable of freely rotating relative to the outer flange assembly and the external bay. The external bay is capable of freely rotation relative to the outer flange assembly and the inner flange assembly. In another embodiment, wire is dispensed from a reel assembly comprising an inner flange assembly and an outer flange assembly. In yet another embodiment, wire is dispensed from a reel assembly comprising an inner flange assembly, an outer flange assembly, and an external bay.

8 Claims, 5 Drawing Sheets

Related U.S. Application Data continuation of application No. 14/072,539, filed on Nov. 5, 2013, now Pat. No. 9,452,908.

(60) Provisional application No. 61/722,478, filed on Nov. 5, 2012.

(51) Int. Cl.
*B65H 75/14* (2006.01)
*B65H 75/18* (2006.01)

(56) References Cited

U.S. PATENT DOCUMENTS

| | | | |
|---|---|---|---|
| 3,152,772 | A | 10/1964 | Schjerven |
| 3,652,026 | A | 3/1972 | Awebro |
| 3,976,260 | A | 8/1976 | Irik |
| 4,784,221 | A | 11/1988 | Share et al. |
| 5,238,200 | A | 8/1993 | Ritzenthaler |
| 6,361,021 | B1 | 3/2002 | Brennan |
| 8,025,261 | B2 | 9/2011 | Jordan et al. |
| 8,245,965 | B2 | 8/2012 | Andrea et al. |
| 8,444,078 | B1 | 5/2013 | Brown et al. |
| 2002/0005451 | A1 | 1/2002 | Valverde |
| 2005/0103918 | A1 | 5/2005 | Bedwell |
| 2008/0023579 | A1 | 1/2008 | Leonard et al. |
| 2010/0084500 | A1 | 4/2010 | Inman et al. |
| 2010/0230528 | A1 | 9/2010 | Singleton |
| 2011/0095124 | A1 | 4/2011 | Andrea et al. |
| 2014/0262663 | A1 | 9/2014 | Draganovic et al. |
| 2015/0129703 | A1 | 5/2015 | Kucera |
| 2015/0321876 | A1 | 11/2015 | Galindo et al. |
| 2016/0244293 | A1 | 8/2016 | Firth |
| 2017/0008718 | A1 | 1/2017 | Evans |

APPARATUS AND METHOD FOR A FREE-SPINNING WIRE DISPENSING REEL

CROSS-REFERENCE TO RELATED APPLICATIONS

This application is a continuation of U.S. patent application Ser. No. 16/823,112, filed Mar. 18, 2020, which has been granted as U.S. Pat. No. 11,111,100, issued on Sep. 7, 2021, which is a continuation of U.S. patent application Ser. No. 15/990,687, filed May 28, 2018, which has been granted as U.S. Pat. No. 10,618,768, issued on Apr. 14, 2020, which is a continuation of U.S. patent application Ser. No. 15/251,695, filed Aug. 30, 2016, which has been granted as U.S. Pat. No. 10,000,356 issued on Jun. 19, 2018, which is a continuation of Ser. No. 14/072,539, filed Nov. 5, 2013, which has been granted as U.S. Pat. No. 9,452,908, which claims the benefit of U.S. Provisional Application No. 61/722,478 filed on Nov. 5, 2012, all of which are herein incorporated in their entirety by reference.

Provisional Application No. 61/722,478 filed on Nov. 5, 2012, all of which are herein incorporated in their entirety by reference.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

This invention relates to wire and cable. More specifically, it relates to an improved wire or cable dispensing reel apparatus incorporating lockable inner and outer flanges and a locking mechanism for enhanced wire or cable payoff.

2. Description of Related Art

Wire and cable are often transported from the site of manufacture to the site of installation using metal and wooden reels. These reels have dimensions of up to 48 inches or larger and carry thousands of pounds of cable or wire. In order to dispense the wire or cable from these reels for installation, the reels must be able to freely spin in order to pay out the wire or cable. The size and weight of the reels when carrying cable or wire present many problems associated with installation at the installation site. In order to dispense wire, the typical method is to lift the reel off of the ground and place it on supporting stands called jack stands. This method is not ideal because it requires additional heavy machinery and personnel to lift the reel onto the jack stands. Additionally, the jack stands occupy space at an installation site where such space may be scarce.

Moreover, many installations require multiple wires to be dispensed and installed together. Traditionally, this requires a reel for each wire and a jack stand for each reel, which further compounds the issues discussed above.

One prior art solution is to deliver the reel on a pre-assembled jack stand affixed to a flat-bed delivery vehicle, such as a semi-trailer truck. This solution, however, requires even more space at the installation site to park the semi-trailer. Additionally, the size of the jack stands limits the number of reels that can fit onto a semi-trailer. Another prior art solution involves the use of portable jack stands that include a built-in lifting mechanism. This solution still requires that the reels be lifted off of the ground and placed in a jack stand. Moreover, this solution requires the use of additional pieces of equipment with associated costs and space requirements.

A prior art solution of dispensing multiple wires includes incorporating multiple bays in one reel, which each wire spooled into each bay. This solution is susceptible to the faults of the prior art solutions discussed above. Additionally, in some installations, at least one wire may be of a different thickness than the remaining wires. In this situation, for each rotation of the reel, more wire of the smaller diameter is dispensed than of the larger diameter wire often causes twists, kinks, or other issues related to efficiently dispensing a plurality of wires for installation at the same time.

Therefore, a need exists for a method and apparatus that allows a plurality of wire or cable to be dispensed from a reel without the need for additional equipment, space, or costs, and where at least one of the wires may be dispensed independently of the remaining wires.

BRIEF SUMMARY OF THE INVENTION

The present invention is directed to a method and apparatus for dispensing wire or cable. In one disclosed embodiment, the apparatus is a reel assembly comprising an inner flange assembly and an outer flange assembly. The inner flange assembly is supported by the outer flange assembly and capable of freely rotating relative to the outer flange assembly.

In another disclosed embodiment, a method and apparatus is disclosed for dispensing a plurality of wires or cables from a reel. The reel assembly comprises an inner flange assembly, an outer flange assembly, and an external bay. The inner flange assembly is supported by the outer flange assembly and capable of freely rotating relative to the outer flange assembly. The inner flange assembly may be divided into a plurality of bays. The external bay is supported by the outer flange assembly and capable of freely rotation relative to both the outer flange assembly and the inner flange assembly.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1:
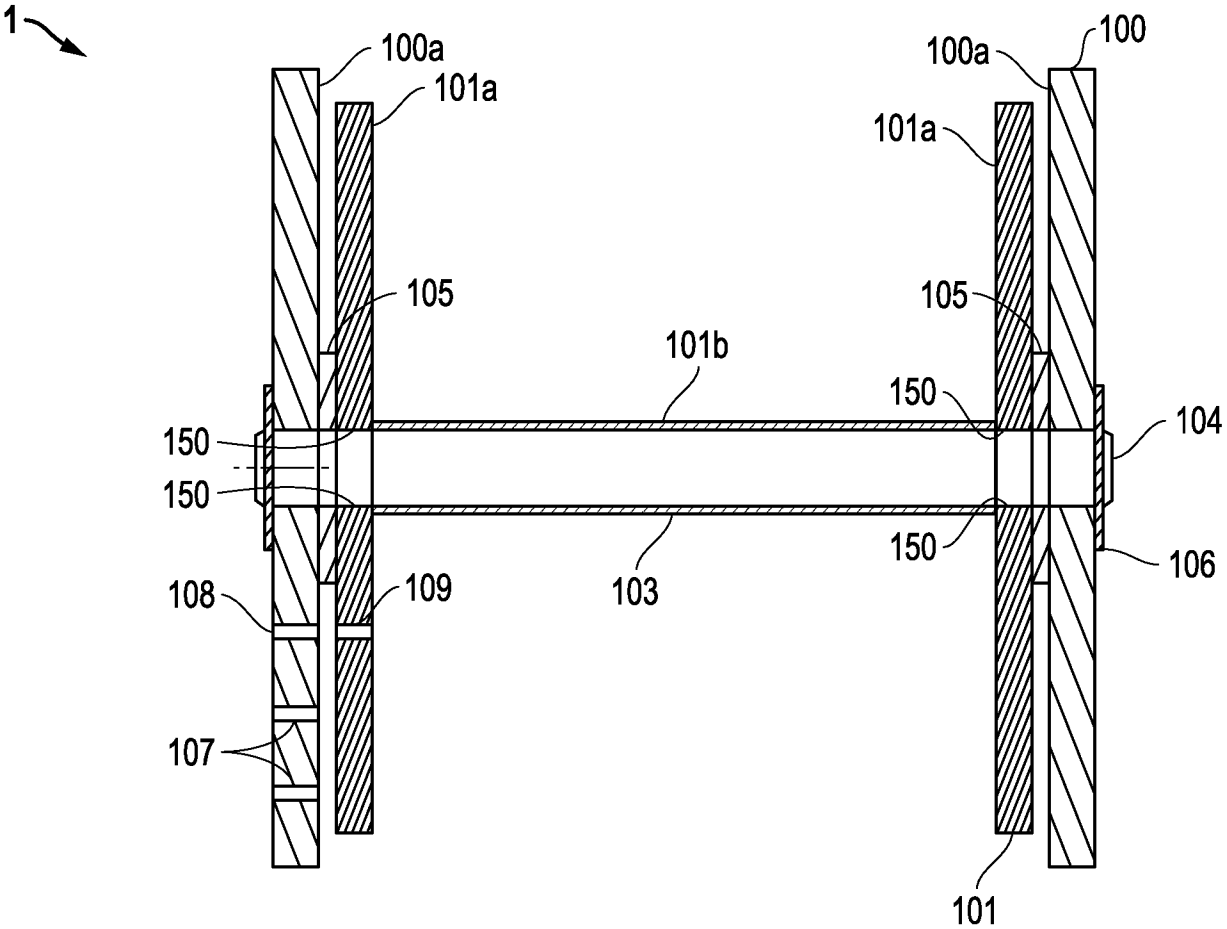
FIG. 1 depicts one embodiment of the reel assembly.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed are for purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by accompanying claims.

The present disclosure is described below with reference to the Figures in which various embodiments of the present invention are shown. The subject matter of the disclosure may, however, be embodied in many different forms and should not be construed as limited to the exemplary embodiments set forth herein. It is also understood that the term "wire" is not limiting, and refers to wires, cables, electrical lines, or any other materials that are dispensed from a reel.

The present disclosure is directed to an apparatus and method for dispensing wire. In one disclosed embodiment, the apparatus is a reel assembly including an inner flange assembly and an outer flange assembly. The inner flange assembly is supported by the outer flange assembly and capable of freely rotating relative to the outer flange assembly. With this design, wire can be dispensed from the reel assembly while the assembly rests directly on the ground or some other surface.

Figure 2:
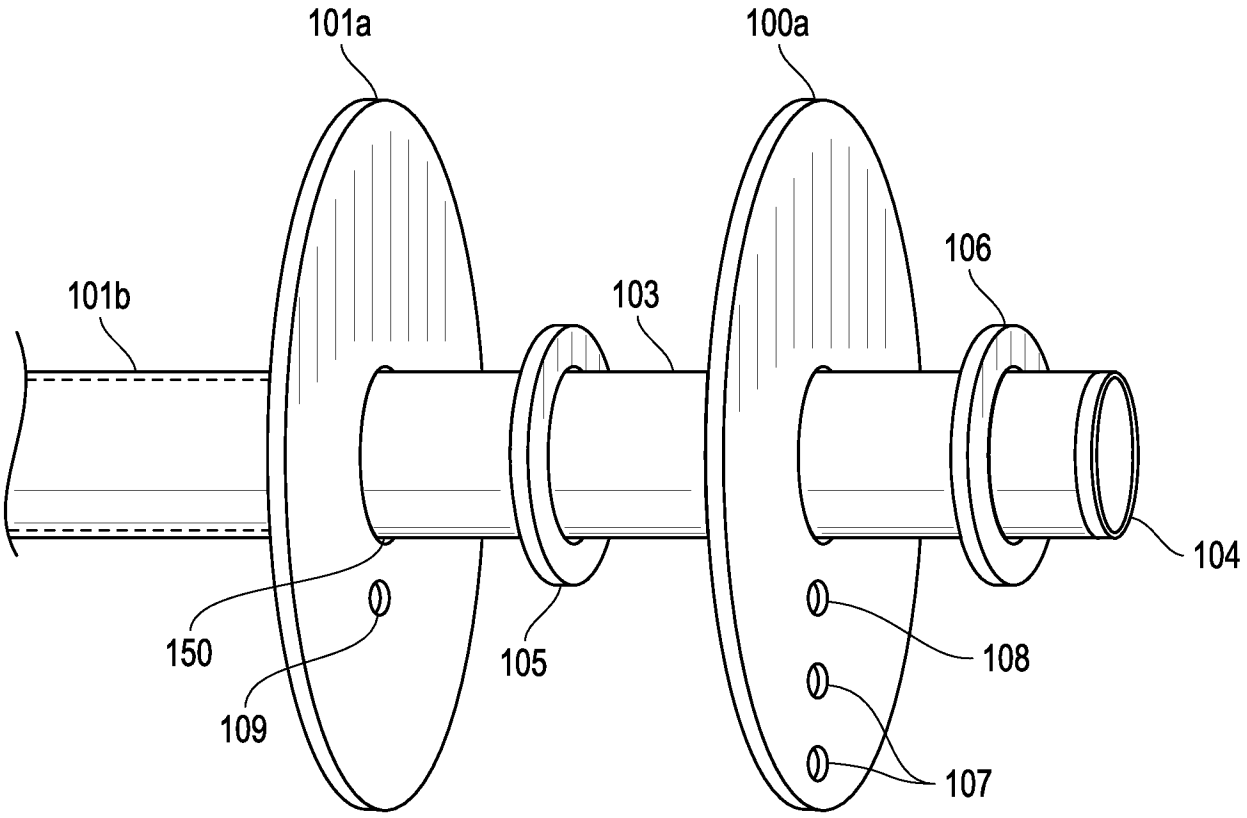
FIG. 2 depicts the outer and inner flange components of one embodiment of the reel assembly.
Figure 3:
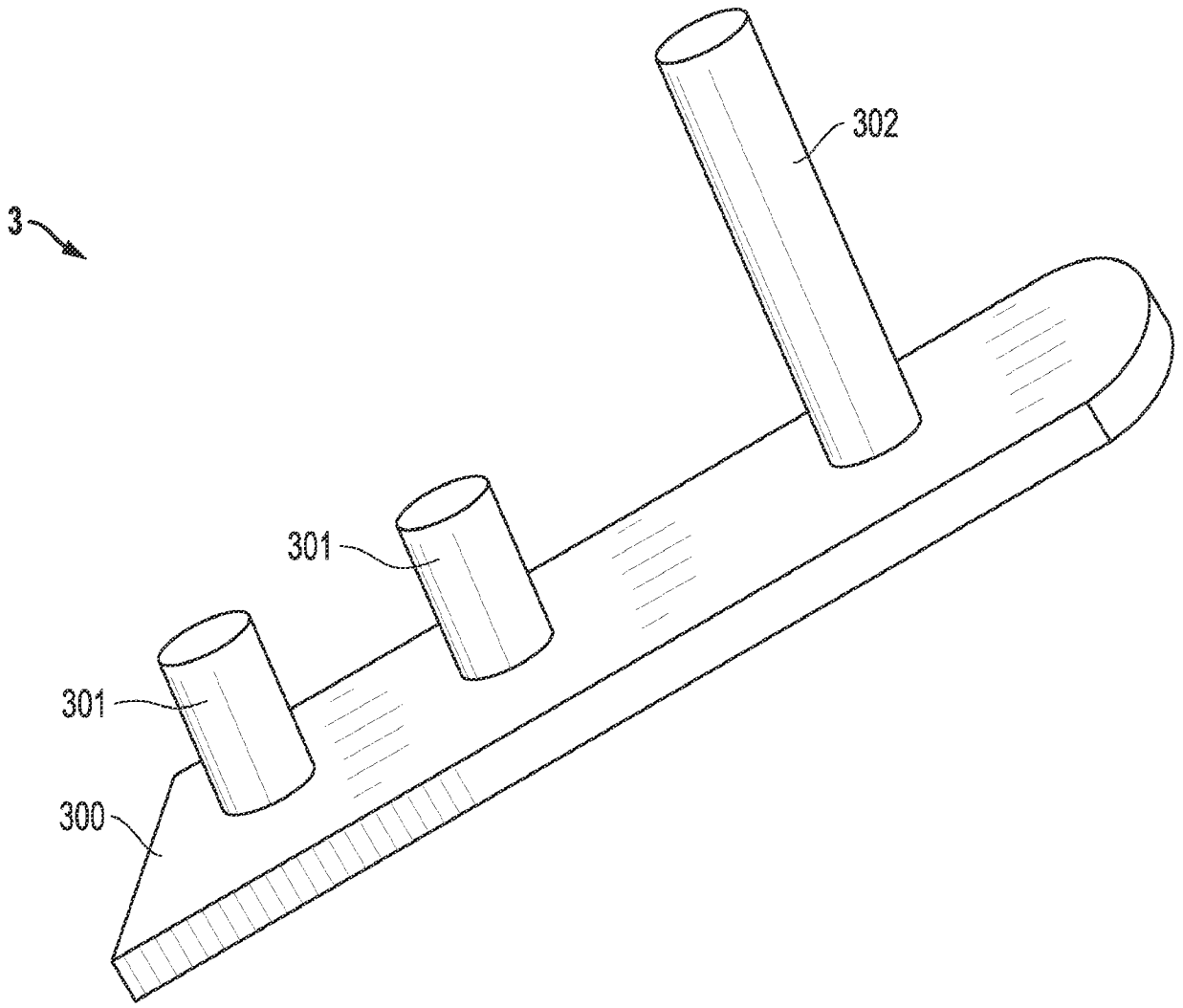
FIG. 3 depicts one embodiment of the reel assembly.

Referring to FIGS. 1 and 2 by way of a non-limiting example, and consistent with the embodiments of the invention, a reel assembly 1 is shown. The reel assembly 1 has an outer flange assembly 100, an inner flange assembly 101 and a pipe 103. The outer flange assembly 100 includes two outer supporting walls 100*a* of substantially equal size and shape connected to the pipe 103 with an outer washer 106. The end of the pipe 103 is machined to form a lip 104 that has a diameter larger than the inner diameter of the outer washer 106, thus enclosing all outer flange assembly 100 components and securing the supporting walls 100*a* to the pipe 103. It is understood to one skilled in the art that a wide variety of enclosing means may be implemented without detracting from the spirit of the invention including, but not limited to, the use of a threaded pipe and nut. The outer supporting walls 100*a* can be various shapes, including but not limited to circular, quadrilateral, or triangular. In a preferred embodiment, the outer supporting walls 100*a* are circular.

The inner flange assembly 101 is formed by at least two inner supporting walls 101*a* of substantially equal size and shape connected by an inner drum 101*b* with an internal radius greater than the radius of the pipe 103. The inner supporting walls 101*a* of the inner flange assembly 101 can also be various shapes, including but not limited to circular, quadrilateral, or triangular. Additionally, the inner supporting walls 101*a* can be bolted to the inner drum 101*b* or can be connected to the inner drum 101*b* in a variety of methods known to those skilled in the art. In one disclosed embodiment, the inner supporting walls 101*a* are circular. Furthermore, in one disclosed embodiment, the inner supporting walls 101*a* are smaller than the outer supporting walls 100*a*. For example, the overall dimensions of the inner supporting walls 101*a* are less than the outer supporting walls 100*a* to allow free spinning of the inner supporting walls 101*a* relative to the outer flange assembly 100 when the inner flange assembly 101 is inserted over the pipe 103. The distance between the inner supporting walls 101*a* is less than the distance between the outer supporting walls 100*a* such that the inner flange assembly 101 is designed to fit within the outer supporting walls 100*a*. An inner washer 105 separates the inner supporting walls 101*a* from the outer supporting walls 100*a*. The drum 101*b* of the inner flange assembly 101 is designed such that the inner diameter of the drum 101*b* is slightly larger than the outside diameter of the pipe 103 to allow free rotation without significant play.

In one disclosed embodiment, the outer supporting walls 101*b* include outer openings or holes 107 and an inner opening or hole 108. The inner supporting walls 101*a* include an inner hole 109 which can be aligned with inner hole 108. The inner hole 108 in the outer supporting wall 100*a* and the inner hole 109 in the inner supporting wall 101*a* are of the same size and shape and the same distance away from the centerline of the reel assembly 1. The outer holes 107 in the outer supporting wall 100*a* are of a similar size and shape relative to each other, and are of a distance further from the centerline than the inner hole 108.

Referring to FIGS. 1-4 by way of non-limiting example, and consistent with embodiments of the invention, the locking and chocking device 3 includes a base 300, minor pegs 301 and major peg 302 which are welded to the base 300. One skilled in the art understands that a wide variety of methods to attach the minor pegs 301 and major peg 302 to base 300 are known and include, but are not limited to, formation of a stamped locking and chocking device 3. Minor pegs 301 are of substantially similar size and shape. The outside diameter of the minor pegs 301 is smaller than the inside diameter of the outer holes 107 on the outer support walls 100*a* and are long enough to extend through the width of the outer support walls 100*a*. The outside diameter of the major peg 302 is smaller than the inside diameters of the inner holes on 108 and 109. The length of the major peg 302 is longer than the width of the outer support wall 100*a*, the inner washer 105 and at least some of the width of the inner support wall 101*a*. In one disclosed embodiment, the cross-section of the minor pegs 301 and major peg 302 are circular, however a wide variety of cross-section shapes may be implemented without detracting from the spirit of the invention, including, but not limited to, square, triangular, and quadrilateral. The locking and choking device 3 can be formed of steel or other materials known to those skilled in the art.

Figure 4B:
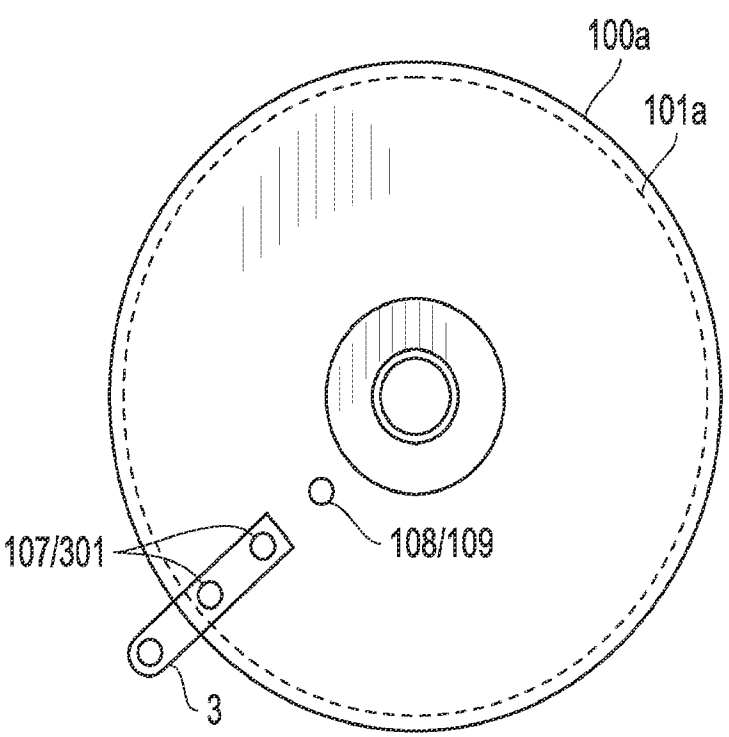
FIGS. 4A and 4B depict one embodiment of the reel assembly illustrating the locking and chocking device in conjunction with the reel assembly.

When assembled, the inner flange assembly 101 is capable of freely rotating about the pipe 103. In one disclosed embodiment, the drum 101*b* and pipe 103 are connected via a lubrication barrier 150, however a wide variety of connection mechanisms may be implemented without detracting from the spirit of the invention, including, but not limited to, bearings or direct contact. In another disclosed embodiment, the inner supporting walls 101*a* contact and rotate around the pipe 103. A lubricant 150 may be applied between the inner supporting walls 101*a* and the pipe 103 to allow for freer rotation. As shown in FIG. 4B, the locking and chocking mechanism 3 is used to impede movement of the reel assembly 1 while still allowing the inner flange assembly 101 to rotate freely about the pipe 103 by inserting the locking and chocking mechanism in an orientation such that the minor pegs 301 are placed into the outer holes 107 and the bar 300 of the locking and chocking mechanism 3 extends beyond the outermost point of the outer support wall 100*a*. In this configuration, the bar 300 and the major peg 302 contact the ground or other surface on which the reel assembly 1 has been placed and impedes the movement of the reel assembly 1. This allows the dispensing of wire by a freely rotating inner flange assembly 101 while the outer flange assembly 100 and the entire reel assembly 1 remain stationary.

Figure 4A:
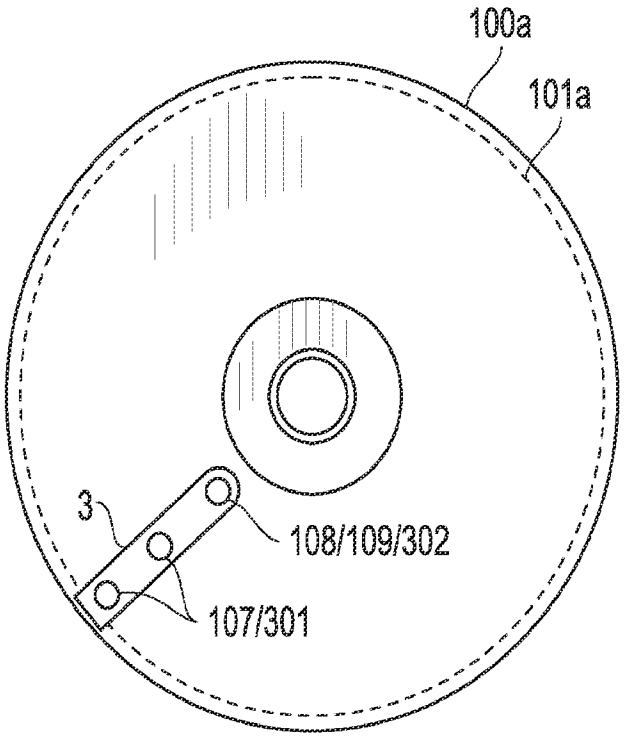

As shown in FIG. 4A, the inner flange assembly 101 is unable to rotate by use of the locking and chocking mechanism 3 and is contemplated for transportation of the reel assembly 1. To prevent the free rotation of the inner flange assembly 101 by the locking and chocking mechanism 3, the locking and chocking mechanism 3 is inserted with an orientation such that the minor pegs 301 align with the outer holes 107 and the major peg 302 is aligned with the inner holes 108 and 109. The locking and chocking mechanism 3 is inserting into the outer holes 107 and the inner holes 108 and 109 which must be aligned. In this configuration, the major peg 302 penetrates the inner hole 108 of the outer support wall 100*a* and the inner hole 109 of the inner support wall 101*a*, and thus impedes the ability of the inner flange assembly 101 from rotating freely relative to the outer flange assembly 100.

In another disclosed embodiment of the invention, a method of dispensing wire from a reel is provided. The wire is dispensed from the reel assembly 1 during a wire pulling event. The reel assembly 1 comprises an inner flange assembly 101 and an outer flange assembly 100. Wire is wrapped around the inner flange assembly 101 for dispensing. The inner flange assembly 101 is supported by the outer flange assembly 100 and capable of freely rotating relative to the outer flange assembly 100. Wire is dispensed from the reel assembly 1 while the assembly rests directly on the ground or some other surface. The locking and chocking device 3 is inserted into the outer holes 107 in the orientation that allows the major peg 302 to extend beyond the outer flange assembly 100 and contact the surface or ground. The contact of the major peg 302 with the surface or ground impeded the rotation of the outer flange assembly 100.

In another disclosed embodiment of the invention, another method of dispensing wire from a reel is provided. A reel assembly 1 containing wire is transported to a wire dispensing site. The reel assembly 1 is placed upon the ground or any available surface. The reel assembly 1 does not need to be placed in a reel jack stand or a premanufactured pallet. The reel assembly 1 can be placed upon any surface. The locking and chocking device 3 is removed. During transportation, the locking and chocking device 3 is oriented so the major peg contacts both the outer flange assembly 100 and inner flange assembly 101, thus preventing rotational movement. The locking and chocking device 3 is reinserted for chocking. The orientation of the locking and chocking device 3 for chocking allows for the minor pegs 301 to contact the outer flange assembly 100 without the major peg 302 contacting the inner flange assembly 101. In such an orientation, the inner flange assembly 101 is independently rotatable from the outer flange assembly 100. In this orientation, the major peg 302 extends from the outer flange assembly 100 and contacts the ground, preventing or impeding rotational movement of the outer flange assembly 100. Wire is drawn from the reel assembly 1.

Figure 5:
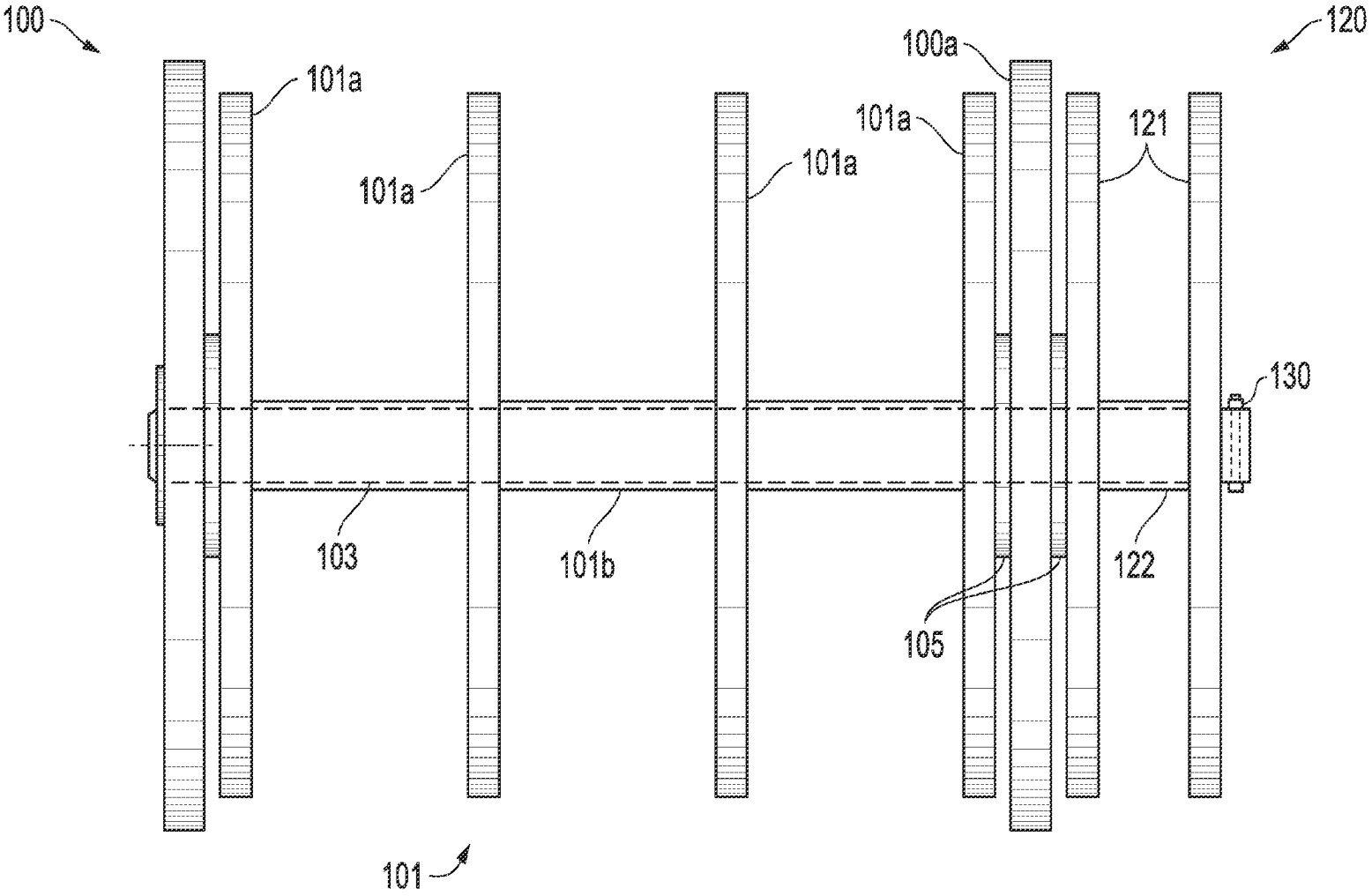
FIG. 5 depicts one embodiment of the reel assembly.

Referring now to FIG. 5, another disclosed embodiment of the present invention shown. Reel assembly 1 includes an outer assembly 100 and an inner assembly 101. As discussed herein, the outer assembly 100 is formed by two outer supporting walls 100*a*. Inner assembly 101 is formed by a plurality of inner supporting walls 101*a*, which form at least two bays in the inner assembly 101. Each of the inner supporting walls 101 is connected to the inner drum 101*b* and all inner support walls 101 move in unison in a way that is independent from the outer assembly 100. In this configuration, a variety of different wire types may be spooled in each bay of the inner assembly 101 allowing for a plurality of wires to be pulled during installation. In another disclosed embodiment, an external bay 120 is attached to the reel assembly 1 outside of the outer flange assembly 100 and a washer 105 may also be placed between the outer flange assembly 100 and the external bay 120. In this embodiment, the external bay would move independently of the inner flange assembly 101 which is contained within the outer flange assembly. The external bay is formed by a two supporting walls 121 and a drum 122 that may be similar to the inner flange assembly 101 and drum 101*b* disclosed herein. In this embodiment, the rotatable bay outside of the outer flange assembly may be removable from the reel assembly 1 and reattached as needed during installation of the wire. In this embodiment, the external bay 120 may be secured to the reel assembly 1 by a pin or bolt 130 inserted into a hole in the pipe 103. One skilled in the art understands that a wide variety of methods to secure the external bay 120 to the reel assembly 1 are known and include, but are not limited to, securing pins or threaded pipe caps.

In another embodiment of the present invention, at least one bay of the inner assembly 101 can move independently from the remaining bays of the inner assembly 101. In this embodiment, the inner drum 101*b* is separated in such a way that the bays of the inner assembly can move independently. In this embodiment, the locking and chocking device 3 must be configured such that it would interact with at least two bays of the inner assembly to securely connect them to the outer assembly 100 during transportation. In another embodiment, a plurality of locking and chocking devices 3 is employed such that each freely rotatable bay or assembly is securely connected to the outer flange assembly 100 during transportation.

One skilled in the art will recognize that different embodiments may be formed in a similar manner having different characteristics depending upon need, performance, or some other criteria. It will thus be appreciated by those skilled in the art that changes could be made to the embodiments described above without departing from the broad inventive concept thereof. It is understood, therefore, that the invention disclosed herein is not limited to the particular embodiments disclosed, but it is intended to cover modifications within the spirit and scope of the present invention as defined by the appended claims.

What is claimed is:

1. An apparatus for dispensing wire, the apparatus comprising:

an outer flange assembly, wherein the outer flange assembly further comprises a first outer wall and a second outer wall;

an inner flange assembly interposed between the first and second outer walls, wherein the inner flange assembly further comprises a first inner wall and a second inner wall, wherein the inner flange assembly can freely rotate relative to the outer flange assembly; and wherein the first outer wall and first inner wall comprise aligned locking holes, wherein the aligned locking holes, when aligned, are capable of receiving a removable device for connection with only the first outer wall and the first inner wall, wherein the device, when connected only with the first outer wall and the first inner wall, impedes the rotation of the inner flange assembly in relation to the outer flange assembly.

2. The apparatus of claim 1, wherein the inner flange assembly further comprises a third inner wall.

3. The apparatus of claim 2, wherein the first, second, and third inner walls form multiple wire dispensing bays.

4. The apparatus of claim 3, wherein the multiple wire dispensing bays rotate in unison.

5. The apparatus of claim 3, wherein the inner flange assembly further comprises a fourth inner wall forming three multiple wire dispensing bays.

6. A wire dispensing system, the system comprising:

an outer flange assembly, wherein the outer flange assembly further comprises a first outer wall and a second outer wall;

an inner flange assembly interposed between the first and second outer walls, wherein the inner flange assembly further comprises a first inner wall and a second inner wall, wherein the inner flange assembly can freely rotate relative to the outer flange assembly;

wire coiled between the two inner walls; and wherein the first outer wall and first inner wall comprise aligned locking holes, wherein the aligned locking holes, when aligned, are capable of receiving a removable device for connection with only the first outer wall and the first inner wall, wherein the device, when connected only with the first outer wall and the first inner wall, impedes the rotation of the inner flange assembly in relation to the outer flange assembly.

7. The system of claim 6, wherein the inner flange assembly further comprises a third inner wall, forming multiple wire dispensing bays and wherein wire is coiled in each of the multiple wire dispensing bays.

8. The system of claim 7, wherein the multiple wire dispensing bays rotate in unison.

* * * * *